US006553632B1

(12) United States Patent
Brumpton

(10) Patent No.: US 6,553,632 B1
(45) Date of Patent: Apr. 29, 2003

(54) BUCKLE

(75) Inventor: Anthony Michael Brumpton, Lincolnshire (GB)

(73) Assignee: Europa Packaging Company Limited (GB)

( * ) Notice: Subject to any disclaimer, the term of this patent is extended or adjusted under 35 U.S.C. 154(b) by 0 days.

(21) Appl. No.: 09/545,892

(22) Filed: Apr. 7, 2000

Related U.S. Application Data

(63) Continuation of application No. PCT/GB97/03439, filed on Dec. 12, 1997.

(30) Foreign Application Priority Data

Oct. 8, 1997 (GB) ..... 9721286

(51) Int. Cl.[7] ..... A44B 11/04

(52) U.S. Cl. ..... 24/200; 24/71.1; 24/68 E; 24/198

(58) Field of Search ..... 24/68 CD, 68 E, 24/71.1, 193, 196, 197, 198, 200, 308, 309

(56) References Cited

U.S. PATENT DOCUMENTS

| | | | | | |
|---|---|---|---|---|---|
| 416,480 | A | * | 12/1889 | Mayer | 24/200 |
| 2,977,655 | A | * | 4/1961 | Peters | 24/196 |
| 3,177,541 | A | * | 4/1965 | Derrickson | 24/200 |
| 3,206,816 | A | * | 9/1965 | Vilcins et al. | 24/200 |
| 3,377,666 | A | * | 4/1968 | Sherman | 24/16 R |
| 3,967,347 | A | | 7/1976 | Bickis, Sr. | 24/200 |
| 3,969,792 | A | * | 7/1976 | Hattori | 24/200 |
| 4,395,803 | A | * | 8/1983 | Krauss | 24/200 |
| 4,571,783 | A | * | 2/1986 | Kasai | 24/200 |
| 4,891,866 | A | * | 1/1990 | Kasai | 24/170 |
| 4,893,382 | A | * | 1/1990 | Lindblad | 24/200 |
| 5,216,786 | A | * | 6/1993 | Anscher | 24/200 |
| 5,307,542 | A | * | 5/1994 | Murai | 24/200 |
| 5,644,822 | A | | 7/1997 | Frew | 24/196 |

FOREIGN PATENT DOCUMENTS

| | | |
|---|---|---|
| GB | 1012588 | 12/1965 |
| GB | 1543762 | 4/1979 |
| GB | 2153000 | 8/1985 |
| WO | WO 94/19254 | 9/1994 |

* cited by examiner

*Primary Examiner*—J. J. Swann
*Assistant Examiner*—Ruth C. Rodriguez
(74) *Attorney, Agent, or Firm*—Factor & Partners

(57) ABSTRACT

The buckle of the invention provides a secure and essentially irreversible means for securing parts of the straps, ideally about compressed inbaled material and/or baled material that is prone to shrinkage. The clip (1) comprises a single component that can easily and quickly be applied by hand and associated strapping maybe re-tensioned as appropriate without removing the clip or straps from or about the baled material. The clip is made to rotate about approximately 180°, whereby forces at a resilient nose portion (8A, 8B) of a gripping member (4A, 4B) are caused to clamp down on a part of a strap.

18 Claims, 3 Drawing Sheets

BUCKLE

This application is a continuation of international application number PCT/GB97/03439, filed Dec. 12, 1997, pending.

The invention of this application discloses a novel clip, for use particularly, but not exclusively in baling and/or bundling and a method of securing straps, particularly but not exclusively, about baled material or bundled material or the like.

Packaging of material into relatively small bundles or the like is typically referred to as baling. Numerous materials such as fabrics (natural or synthetic), agricultural products, boxed products, waste products or indeed any such material that it is desired to form into discrete and transportable bundles may be the subject of baling. It is known from the prior art to use ropes, straps, bands or the hike and to connect ends of said ropes, straps, bands or the like and to join the ends together so as to form a continuous loop about the baled material. Furthermore it is known to use knots or clips or buckles or locks so as to facilitate the joining together of ends of strapping whereby strapping can be tensioned so as to maintain the baled material in a compressed state. In some instances the pressure within the baled material is harnessed so as to enhance the strength of the strapping about the baled material. Notably, baled material, in its compressed state, exerts pressure upon any containment means therefore connection/attachment means that can prevent slipping of the strapping material is important so as to keep the material in a compressed state.

However, conventional connection attachments are prone to failure, either by failure of the connection/attachment means itself or failure of the strapping. In the instance of a failure of either component the compressed baled material expands and can escape and scatter. The baled material can therefore be damaged in so doing and thus this scenario is potentially inconvenient and hazardous at the site of where the contents spill and/or to somebody transporting said baled material and/or the recipient of the baled goods. Furthermore failure of the components can be costly due to breakages of fragile baled material and the like. It is important economically, and for ease of transport, to compress material into as small a volume as possible so as to reduce transportation costs and to maintain the compressed state of baled material over prolonged periods during storage and/or transportation.

Typically, baled material is constrained by multiple straps usually in the region of 6 to 15 crossing straps per bale are used and connection/attachments means. The strap may be any width that is needed to contain the compressed material. Where it is desirable to contain highly compressed bales strapping material is typically constructed of metal or toughened polypropylene or polyester, natural or synthetic cord including rope and fashioned so as to withstand high compression forces. Typically hand applied clips only provide downwards of 50% efficiency, therefore in the instance of wishing to provide a fail safe and more efficient means of baling using hand applied clips there is a deficiency in the market.

Some materials, such as wood or forestry material or wood products, especially in the instance of being left to mature, undergo natural shrinkage. Thus, a bale of wood that has been bailed can reduce in size over time. Typically the straps are removed and replaced with new tight strapping, accordingly there is considerable wastage of bale straps and component parts thereof. Thus, a clip that permits in situ re-tensioning of straps would offer immediate advantage, further advantage would be gained if said clip could also provide a one way only bite i.e. the same principle as a barbed fishing hook, so as to provide secure and non-slip tensioning about baled material. Such a device and method for re-tensioning would provide an immediate solution to problems in the packaging industry of bailing materials that are prone to natural shrinkage over time and during selected conditions such as during transit and for materials baled on or about a wooden pallet or the like.

Furthermore, current connection/attachment means are disposable and therefore can be considered environmentally unfriendly, it would therefore be advantageous to provide a clip which is capable of withstanding high forces for prolonged periods and which can be used and/or re-tensioned many times over, additionally the clip may be made of recyclable material.

The invention of this application has overcome many of the problems associated with the prior art by providing a novel clip whereby efficient hand appliance is improved dramatically and further, reliability of baling is also improved. Additionally said novel clip and associated strapping can be re-tensioned so as to bale material that is prone to natural shrinkage over a period of time or as a result of specific conditions.

It is therefore a first object of the invention to provide an efficient clip for baling compressed material.

It is yet a further object of the invention to provide a non-slip, versatile, re-usable clip.

It is a yet further object of the invention to provide a clip which enables re-tensioning of strapping associated therewith.

According to a first aspect of the invention there is provided a clip comprising an elongate body having two ends and having a turning point therebetween, wherein said body comprises at either end a securing means for securing at least two parts of a strap relative to each other, said securing means comprising a first and second gripping member adapted to accommodate at least one of said two parts of said strap therebetween, and wherein a central longitudinal axis of each securing means is positioned substantially parallel to and displaced on opposite sides of a central longitudinal axis of the clip.

It will be understood that in use, an end of a first strap is secured by threading same between and about at least one of the gripping members at one end of said clip, and another end of said same strap, or alternatively, an end of a different strap is secured by threading same between and about at least one of the gripping members at the other end of said clip. Thereafter, the free end(s) of the strap or straps, held by the gripping members, are pulled or tensioned in opposite directions until a turning moment is reached and this causes the elongate body of the clip to rotate about the turning point by approximately 180° and in doing so the gripping members are wrapped further and, in use essentially irreversibly, about said strap or straps. In this way, advantageously, the gripping force is co-directional with the constraining force.

In a yet further preferred embodiment of the invention said clip comprises ideally, a single component ideally with at least one access region, whereby said strap is threaded through same and about said gripping members.

In a yet further preferred embodiment of the invention said clip is constructed from a robust, rust-proof, durable material ideally from plastics and more ideally is high pressure injection moulded from said plastics and even more ideally is provided as a composite of plastics and filled glass fibres preferably said fibres are nylon filled and more preferably still are polycarbonate filled.

In a yet further preferred embodiment of the invention said clip is provided preformed and is attached to or associated with at least one end of a predetermined length of said strap.

In a yet further preferred embodiment of the invention said first and second gripping members are substantially elongate and even more ideally each of said second gripping members is marginally greater in length than each of said first gripping members.

In a yet further preferred embodiment of the invention said first gripping member is provided with at least one recess suitably positioned, and of a predetermined length, along at least one side; and ideally is provided with a second recess along an opposite side and even more ideally said recesses are of equal length and are positioned at an end of said gripping member wherein said end is the end nearest said turning point. This construction provides a first gripping member with a flexible nose portion.

In a yet further preferred embodiment of the invention said first gripping member is of differential cross-sectional thickness along its length, a thickest cross-sectional area being at an end remote from said turning point. Thus the first gripping member is ideally wedge shaped.

In a yet further preferred embodiment of the invention said first gripping member comprises a nose portion substantially positioned between said recesses, ideally said nose portion is suitably resilient and even more ideally said nose portion is suitably curved at an edge nearest said turning point, the angle of curvature is selected so as to improve performance and most ideally said nose portion is of a suitable thickness so as to be resilient.

It will be appreciated by those skilled in the art of providing a clip that the angle of curvature of said nose portion is directly proportional to the efficiency of said clip and that, the greater the angle of curvature, the greater the efficiency achieved. In this way, in use, a strap is wrapped about a curved gripping member and so the risk of damaging said strap is minimised. Furthermore by providing a gripping member of differential cross-sectional thickness along its length, the thickest part being remote from said turning point, with recesses along at least a part of a thinner nose portion such configuration confers resiliency to said nose portion, so that in use said nose portion deforms and presses against at least a first part of the strap.

In a yet further preferred embodiment of the invention said nose portion is constructed of a different material to said gripping member, and said nose portion is suitably and permanently attached thereto. However it will be appreciated that said nose portion is ideally integral with said gripping member of said securing means, but in some instances it may be made separately of a different resiliently deformable material and securely affixed to said gripping member.

In a yet further preferred embodiment of the invention said second gripping member is of substantially even cross-sectional area along its length and comprises a curved end, said curved end being nearest to said turning point, ideally said end is curved so as not to present sharp and/or right angled edges to a strap means and create weak point(s). Notably also, said curved end of said second gripping member cooperates with said curved nose portion so as to provide almost a continuous curved surface against which said strap bears during use.

According to a second aspect of the invention there is provided use of a clip as hereinbefore described in baling compressed material.

According to a further aspect of the invention there is provided use of a clip as hereinbefore described in baling material that is prone to natural shrinkage over a period of time and/or as a result of specific conditions.

According to a yet further aspect of the invention there is provided a method for securing two parts of a strap relative to each other about baled and ideally compressed material comprising;

i) placing at least a part of one strap means about at least a part of material that is to be baled, and providing at least one clip in accordance with the invention;

ii) inserting an end of a strap a selected distance into an access portion of said elongate body of said clip;

iii) threading said strap between and about at least one of said gripping members;

iv) repeating steps ii) and iii) at the other end of said elongate body where appropriate, using the same or an alternative strap;

v) applying suitable, substantially equal and opposite tension to selected end(s) of said strap so as to reach and overcome a turning moment, rotating said clip by approximately 180° whereby said strap(s) is/are further wrapped about said securing means and a clamping force is applied to said strap(s).

According to a yet further aspect of the invention there is provided a method for securing two parts of a strap relative to each other about baled material that is prone to natural shrinkage over a period of time and/or as a result of specific conditions, comprising:

i) placing at least a part of one strap means about at least a part of material that is to be baled, and providing at least one clip in accordance with the invention;

ii) inserting an end of a strap, a selected distance into an access portion of said elongate body of said clip;

iii) threading said strap between and about at least one of said gripping members;

iv) repeating steps ii) and iii) at the other end of said elongate body where appropriate, using the same or an alternative strap;

v) applying suitable, substantially equal and opposite tension to selected end(s) of said strap so as to reach and overcome a turning moment, rotating said clip by approximately 180° whereby said strap(s) is/are further wrapped about said securing means and a clamping force is applied to said strap(s);

vi) re-tensioning said strap(s) about said baled material that has undergone natural shrinkage, by applying a suitable re-tensioning force by means of a standard re-tensioning tool to selected end(s) of said strap(s) so as to advance said strap(s) further over said gripping means in a non-reversible fashion;

vii) repeating step vi) as appropriate in accordance with the rate and extent of natural shrinkage of said baled material.

According to yet a further aspect of the invention there is provided use of a clip as hereinbefore described and component parts thereof in baling material.

According to a yet further aspect of the invention there is provided use of a clip as hereinbefore described and component pars thereof in baling material that is prone to nature shrinkage over a period of time and/or as a result of specific conditions.

The invention will now be described by way of example only with reference to the following figures wherein.

FIGS. 5A to F represent side cross-sectional views of a clip during the process of threading and securing a strap.

Figure 5A:
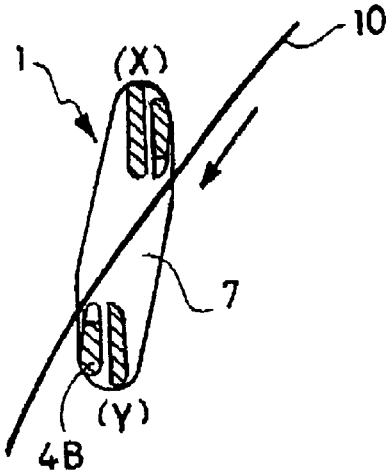
Figure 5B:
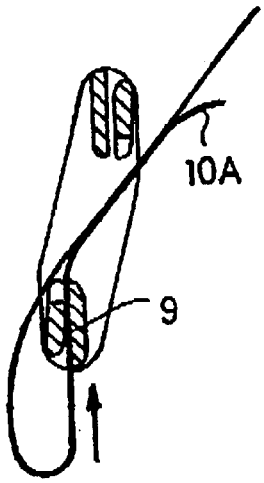
Figure 5C:
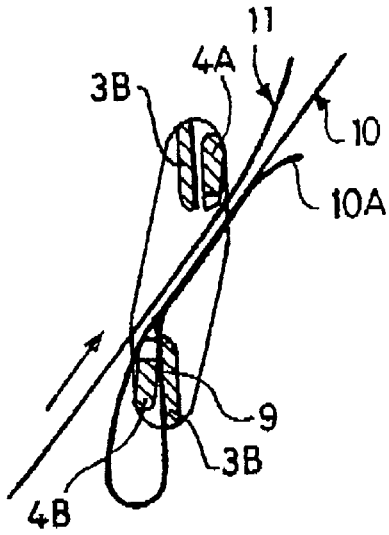
Figure 5D:
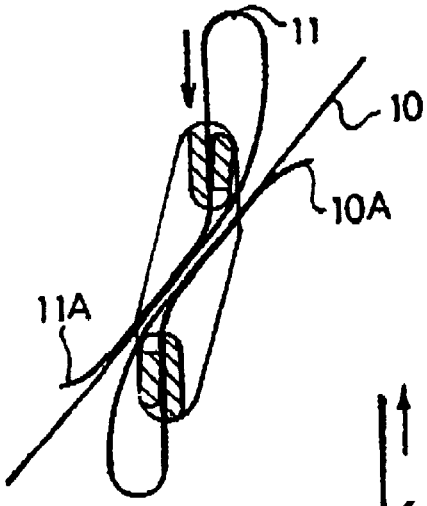
Figure 5E:
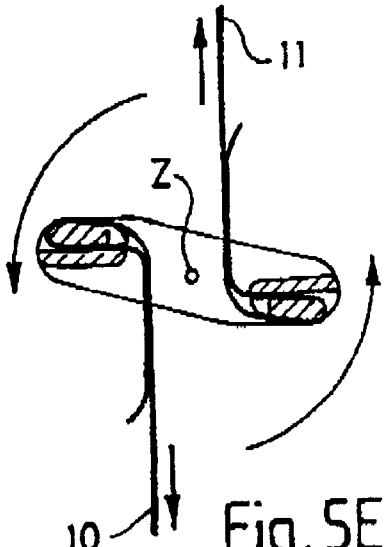
Figure 5F:
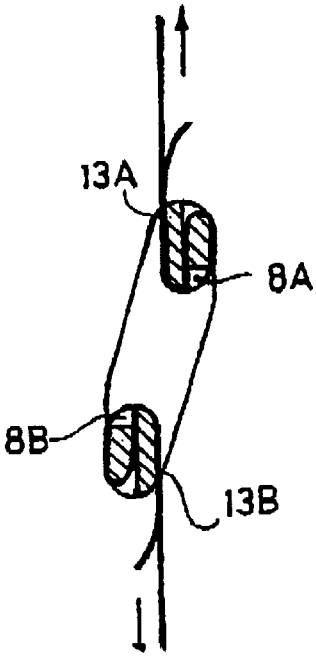
Figure 6:
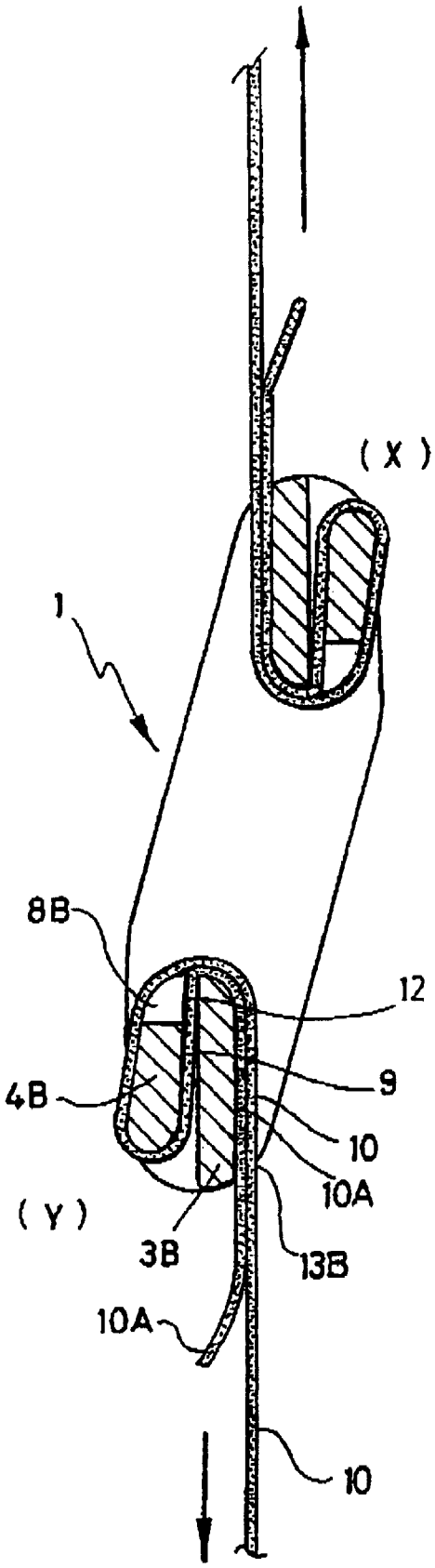

FIG. 6 represents an exploded view of FIG. 5F.

Figure 1:
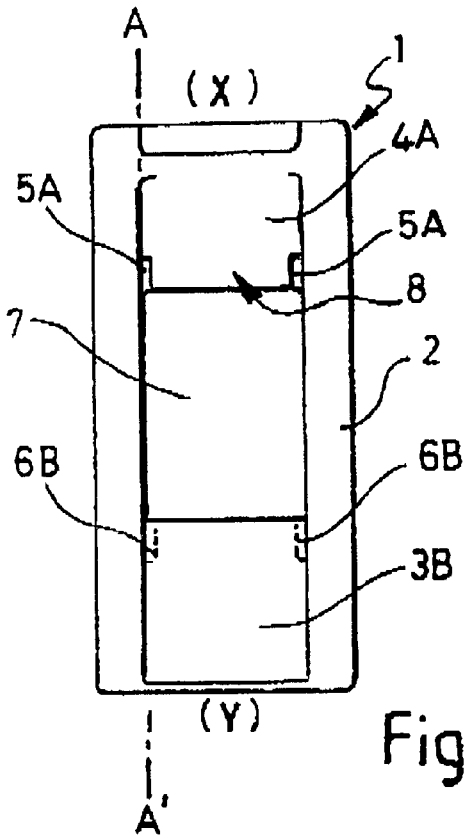
FIG. 1 represents a plan view of a clip.

With reference to FIG. 1 there is shown a clip 1 comprising an elongate body 2 with ends X and Y defining an essentially open central access region 7. At either end of clip 1 there is provided a securing means comprising a first and second gripping members. At end Y the securing means comprises members 3B and 4B; and at end X the securing means comprises members 3A and 4A. At an end Y of clip 1 there is shown a second gripping member 3B which is superimposed over a first gripping member (not shown) which member is provided with a pair of recesses 6B (shown as dotted lines). At an opposite end X a first gripping member 4A is shown provided with visible recess portions 5A, the area between said recesses essentially defining a nose portion 8. Centrally positioned in region 7 there exists a turning point about which the clip rotates in use and under sufficient applied tensioning force as will be described in greater detail hereinafter.

Figure 2:
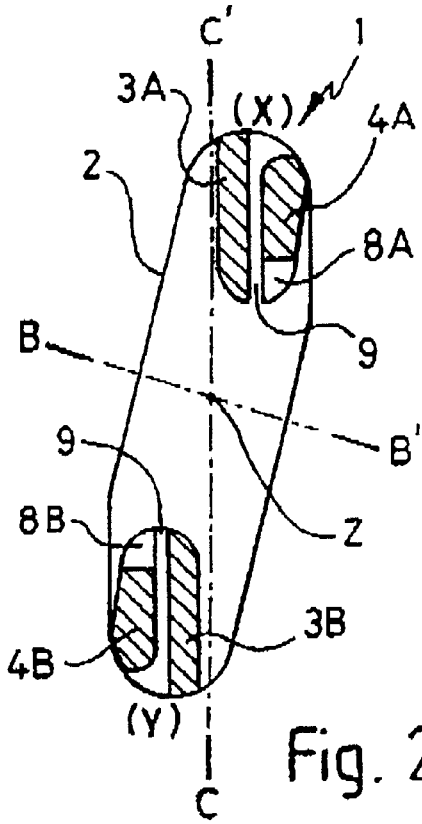
FIG. 2 represents a side cross-sectional view through line A–A' of a clip as shown in FIG. 1.

With reference now to FIG. 2 there is shown a side cross-sectional view of clip 1 through line A to A' as depicted in FIG. 1, in this particular view of clip 1, it is apparent that the securing means at end X and the other securing means at end Y are positioned so that their central longitudinal axis is parallel with a central longitudinal axis (C to C') but notably said securing means at ends X and Y are displaced on opposite sides of said central longitudinal axis (C to C').

The securing means comprises oppositely positioned first and second gripping members. At either end of the clip 1 first and second gripping members are space thereapart so as to provide a cavity 9 of suitable size so that a strap can be threaded therethrough.

Each of said first gripping members are provided with resilient nose portions 8A and 8B. In this embodiment of the invention nose portions 8A and 8B are made from a plastics material and the fashioning of the same by the inclusion of recesses 5A, 5B, 6A, 6B confers on the tip of nose portions 8A and 8B resilience in other embodiments of the invention resilience of his kind may be provided using other means known to those skilled in the art. A second transverse central axis B to B' is shown wherein the intersection of axes B to B' and C to C' define a plane Z which plane defines the turning point about which clip 1 rotates in use when the turning moment has reached a critical point.

Figure 3:
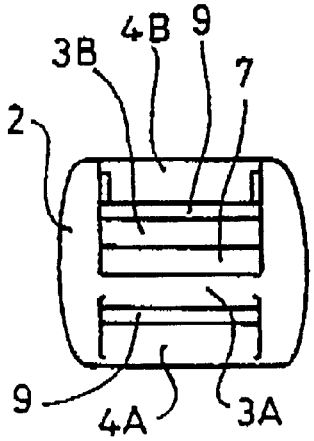
FIG. 3 represents an end view of a clip.

It will be appreciated that in the representation of an end view of a clip as depicted in FIG. 3 each end is provided with a first gripping member (4A and 4B) and a second gripping member (3A and 3B) and in between each of these members there is cavity 9; additionally midway between each of said pairs of gripping members is central access region 7.

Figure 4:
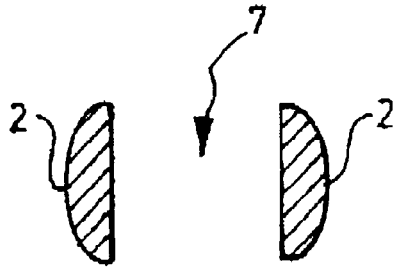
FIG. 4 represents a side cross-sectional view rough a clip along line B–B' as shown in FIG. 2.

With reference to FIG. 4, which illustrates a side cross-sectional view of clip 1 along line B to B' as illustrated in FIG. 2 there is shown more clearly access region 7 between two sides of elongate body 2. It will be appreciated that sides of elongate body 2 are substantially rounded so as not to present sharp surfaces/edges to a strap and create weak points.

In use, with reference to FIGS. 5A to F, a part or end of a strap 10 is passed through access region 7 of clip 1 towards end Y of said clip so as to pass along at least a part of a surface of first gripping member 4B. Subsequently, with reference to FIG. 5B strap 10 is threaded between said first and second gripping members through region 9 so as to fold back upon itself and to effectively wrap around first gripping member 4B. A free end 10A projects outwardly from clip 1 on a right hand side. Subsequently (FIG. 5C) a second end of a strap 11 is threaded similarly through central access region 7 so as to pass by first gripping member 4A at an opposite end. Said strap is then folded around the first gripping member of the opposite end so as to be wrapped around same, and to provide an end 11A which projects outwardly from clip 1 on a left hand side (FIG. 5D). Tension is then applied in opposite directions as indicated by the arrows on FIG. 5E along the length of straps 10 and 11 so as to cause clip 1 to rotate about a plane running through turning point Z. As the clip rotates straps 10 and 11 are wrapped further about the securing means and specifically about the second gripping members, moreover when the clip has rotated approximately 180° (FIG. 5F) further tensioning causes nose portions 8A and 8B of said first gripping members to be depressed and to firmly press against second gripping members sandwiching a part of a strap therebetween. Thus the nose portions 8A and 8B and the curved innermost ends of second gripping members 3A and 3B provide a curved surface against which straps 10 and 11 bear in use. In an alternative embodiment of the invention, not shown, a single strap may be threaded between ends X and Y of clip 1 Furthermore it will be appreciated that in the instance of baling material that is prone to natural shrinkage said strap(s) 10 and 11 can be selectively re-tensioned.

With reference to FIG. 5F there is shown an exploded view in FIG. 6, where it can be seen that strap 10 is wrapped about a first gripping member 4B so as to depress nose portion 8B along surface 12 towards second gripping member 3B whilst sandwiching said strap therebetween. It will be appreciated that a double thickness of strap comprising 10 and 10A exits at an area 13B at end Y of clip 1. Similarly, a double thickness of strap comprising 11 and 11A exits at an area 13A at end X of buckle 1. It will be apparent from this figure tha the gripping force holding strap 10 (and 11) in place is co-directional with the constraining force when the strap(s) and clip are in use. This arrangement maximises the efficiency of the invention.

It will be appreciated, by those skilled in the art, that in the instance of baling material that is prone to natural shrinkage over a selected period of time and/or as a result of specific conditions, said strap 10 and/or 11 may be re-tensioned by using a standard re tensioning tool and applying a suitable re-tensioning force to ends 10A and/or 11A so as to permit straps 10 and/or 11 to advance further over nose portion(s) 8B and/or 8A in a non-reversible manner.

Thus, in use, the clip of the invention provides a novel, inventive, secure and essentially irreversible means for securing parts of straps, ideally about compressed baled material or baled material that is prone to shrinkage. The device is efficient, reusable, and may be easily and quickly applied by hand and may be re-tensioned as appropriate without removing said clip or said strap(s) from or about said baled material.

What is claimed is:

1. A buckle:

incorporating separate spaced-apart strap-securing means through each of which, in use, a strap end can be threaded and then be pulled through the buckle to tighten the buckled strap progressively around an outside object;

each of strap securing means comprising a pair of opposed gripping members or jaws between which a respective strap end can be passed and around which an adjacent region of a remainder of a respective strap end can then be looped in a manner which will allow a respective strap end to slide against one another as the strap is pulled through the buckle;

and with each such pair of jaws being laterally offset relative to each other in such a way so that resulting forces acting on the buckle, after the strap is tightened, create a turning moment urging the buckle to rotate through substantially 180° about a generally centrally positioned axis thereby frictionally trapping a respective strap end in the buckle.

2. A buckle according claim 1 in which at least one jaw is of differential cross-sectional thickness with the region of thickest cross-section facing the other pair of jaws.

3. A buckle according to claim 1 wherein at least one jaw is substantially elongate.

4. A buckle according to claim 3 wherein one jaw is longer than the other jaw of its pair.

5. A buckle according to claim 1 wherein a suitably positioned recess partially separates at least one of the jaws of each pair from an adjacent region of the buckle.

6. A buckle according to claim 5 and in which at least one additional recess if formed in at least one of the jaws.

7. A buckle according to claim 6 wherein each recess is of substantially equal length and are formed in a region of the jaw facing the other pair of jaws.

8. A buckle according to claim 6 wherein one of the jaws of each pair is formed by a nose portion positioned substantially between the recesses and the at least one additional recess.

9. A buckle according to claim 8 wherein said portion is resilient.

10. A buckle according to claim 8 wherein the nose portion is curved about an edge facing the other pair of jaws.

11. A buckle according to claim 8 wherein the nose portion is made from a different material to that of a remaining portion of the jaw.

12. A buckle:

incorporating separate spaced-apart strap-securing means through each of which, in use, a strap end can be threaded and then be pulled through the buckle to tighten the buckled strap progressively around an outside object;

each of strap securing means comprising a pair of opposed gripping members or jaws between which a respective strap end can be passed and around which an adjacent region of a remainder of a respective strap end can then be looped in a manner which will allow a respective strap end to slide against one another as the strap is pulled through the buckle;

and with each such pair of jaws being offset relative to each other in such a way so that resulting forces acting on the buckle after the strap is tightened, create a turning moment urging the buckle to rotate through substantially 180° thereby frictionally trapping a respective strap end in the buckle; and a suitably positioned recess partially separates at least one of the jaws of each pair from an adjacent region of the buckle and in which at least one additional recess if formed in at least one of the jaws.

13. A buckle according to claim 12 wherein each recess is of substantially equal length and are formed in a region of the jaw facing the other pair of jaws.

14. A buckle according to claims 12 wherein one of the jaws of each pair is formed by a nose portion positioned substantially between the recesses and the at least one additional recess.

15. A buckle according to claim 14 wherein said portion is resilient.

16. A buckle according to claim 14 wherein the nose portion is curved about an edge facing the other pair of jaws.

17. A buckle according to claims 14 wherein the nose portion is made from a different material to that of a remaining portion of the jaw.

18. A buckle:

incorporating separate spaced-apart strap-securing means through each of which, in use, a strap end can be threaded and then be pulled through the buckle to tighten the buckled progressively around an outside object;

each of strap securing means comprising a pair of opposed gripping members or jaws between which a respective strap end can be passed and around which an adjacent region of a remainder of a respective strap end can then be looped in a manner which will allow a respective strap end to slide against one another as the strap is pulled through the buckle;

and with each such pair of jaws being offset relative to each other in such a way so that resulting forces acting on the buckle, after the strap is tightened, create a turning moment urging the buckle to rotate through substantially 180° thereby frictionally trapping a respective strap end in the buckle;

and at least one jaw is of differential cross-sectional thickness with the region of thickest cross-section facing the other pair of jaws.

* * * * *